United States Patent [19]

Konno

[11] Patent Number: 4,769,970

[45] Date of Patent: Sep. 13, 1988

[54] AUTOMATIC PACKING MACHINE

[75] Inventor: Kan Konno, Kanagawa, Japan

[73] Assignee: JCC Engineering Co., Ltd, Tokyo, Japan

[21] Appl. No.: 76,763

[22] Filed: Jul. 23, 1987

[51] Int. Cl.[4] ..... B65B 13/06

[52] U.S. Cl. ..... 53/176; 53/589; 198/414

[58] Field of Search ..... 53/176, 587, 588, 589, 53/544; 198/346.2, 379, 414

[56] References Cited

U.S. PATENT DOCUMENTS

| | | | |
|---|---|---|---|
| 3,783,773 | 1/1974 | Willard | 53/589 X |
| 4,553,372 | 11/1985 | Back | 53/587 X |
| 4,598,534 | 7/1986 | Rosenthal | 53/588 |

*Primary Examiner*—John Sipos
*Attorney, Agent, or Firm*—Robert F. Ziems

[57] ABSTRACT

A packing machine for automatically banding a package is described, wherein belt conveyers are provided in combination with a table for transporting a package to be banded with respect to an arch on the table for enabling the machine to band the package with a band guided by the arch, and means is provided for vertically moving the table with respect to the conveyers between an initial lower position in which the conveyers may transport the package with respect to the arch and a position of a level higher than the level at which the conveyers are located so as to enable the machine to smoothly turn said package on the table elevated to the higher level in accordance with a selected package banding mode.

3 Claims, 6 Drawing Sheets

Fig.4-A
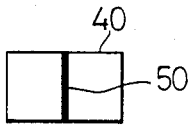
Fig.4-B
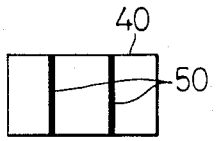
Fig.4-C
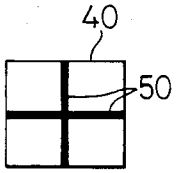
Fig.4-D
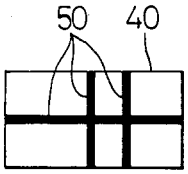
Fig.4-E
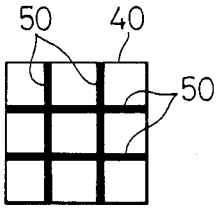

AUTOMATIC PACKING MACHINE

BACKGROUND OF THE INVENTION

The invention relates to an automatic packing machine, especially for orienting an object such as a package of corrugated cardboard containing something packed therein so that such a box may be easily banded as required.

It has been generally known that a corrugated cardboard package is banded with the modes such as a single banding mode as shown in FIG. 4-A, a double parallel banding mode as shown in FIG. 4-B, a cross banding mode as shown in FIG. 4-C, a crossed single and double parallel banding mode as shown in FIG. 4-D, a crossed double parallel banding mode as shown in FIG. 4-E, etc. According to the conventional packing machine, it is required that the package is manually oriented on the machine in accordance with the banding modes as mentioned above. Namely in reference to the banding mode as shown in FIGS. 4-C through FIG. 4-E which require banding in two directions, that is, the lateral and longitudinal directions, the packing machine M is operated to and the package in one direction thereof and then the package is required to be manually oriented so that the package may be banded in the other direction.

More precisely, according to the conventional packing machine having no turnable or rotatable oriented device provided therewith, it is required that the machine operator manually orient the package by turning the same on a machine table so that the package may be banded in a desired type.

FIG. 5 is a front elevational view of a conventional automatic packing machine having a turnable or rotatable oriented device, and FIG. 6 is a side elevational view of the above mentioned packing machine. The packing machine 1 is composed substantially of a banding device 2 for winding a band around a package to be banded, and welding and subsequently cutting the band, a transporting device 3 for transporting the package to the banding device 2 and then transporting the banded package away from the banding device and a driving device 4, which is not particularly illustrated, for driving the banding device and the transporting device 3.

The banding device 2 is composed of an arched guide gate 6 fixedly mounted on a table 5 of the machine 1, a welding part 7 for welding the superposed parts of the band under the table 5 and a cutting part 8 for cutting the band at the part thereof adjacent the welded part on the side of the band supply.

The transporting device 3 is composed of a pair of conveyers 9, provided on the table 5 defining a path 10 extending past the guide gate 6. The banding device 2 is provided in the package transporting path 10 and an orienting device 11 is provided above the banding device 2. The orienting device is turnable in a horizontal plane and includes a pair of arms 12 extended down toward the transporting path 10 for holding and orienting the package on the transporting path 10. The orienting device 11 is operated to turn the package W by 90° to thereby orient and position the package W with respect to the banding device 2 so that the latter may band the package W with the cross banding mode or the crossed single and double parallel banding mode.

However, the conventional automatic packing machine includes problems to be solved in its operation which is extremely limited for dealing with the package. Especially since the rubber belt conveyers are located on a level higher than the level of the table, which prevents the packing machine from smoothly turning the package on the table considerably detracting from the operation efficiency. Moreover this will inevitably damage the belt conveyers. Further the holding arms 12 often injure the package and fail to correctly position the package at a predetermined place. Further the holding arms are designed to hold up the package from the table and then turn the package, and therefore a considerable load is applied to the arms as well as to the package to be held by the arms.

OBJECTS OF THE INVENTION

The invention has been provided to eliminate the above mentioned defects and disadvantages of the prior art. It is a primary object of the invention to provide a new automatic packing machine having a table which is designed to be vertically moved with respect to rubber belt conveyers for transporting a package to be banded, so that an orienting device may smoothly turn and position the package on the table with respect to a banding device. It is another object of the invention to return the table to the initial position after the package is turned by the orienting device so that the belt conveyers may further transport the package with respect to the banding device. The other features and advantages of the invention will be apparent from the following description of the invention in reference to a preferred embodiment as shown in the attached drawings.

SUMMARY OF THE INVENTION

In short, the invention relates to an automatic packing machine having a table having an upright arch fixedly mounted thereon, a turner turnably mounted on the arch and linearly movable with respect to the arch and having at least a pair of holding arms operatively connected thereto and depending toward the table and being movable in association therewith for holding and turning a package placed on the table to be banded with a band in a predetermined banding mode, the arch being so structured as to guide the band extended from a band supply, and belt conveyers arranged in combination with the table and located on a level slightly higher than the level of the table for transporting the package with respect to the arch, said automatic packing machine comprising means operatively connected to said table and operated to vertically move said table with respect to said conveyers between an initial lower position in which said conveyers may transport said package with respect to said arch and a position of a level higher than said level at which said belt conveyers are located.

BRIEF DESCRIPTION OF THE DRAWINGS

FIG. 4-A through 4-E are plan views of packages banded with different banding modes depending upon the size and shape of the packages;

DETAILED DESCRIPTION OF THE INVENTION

Figure 1:
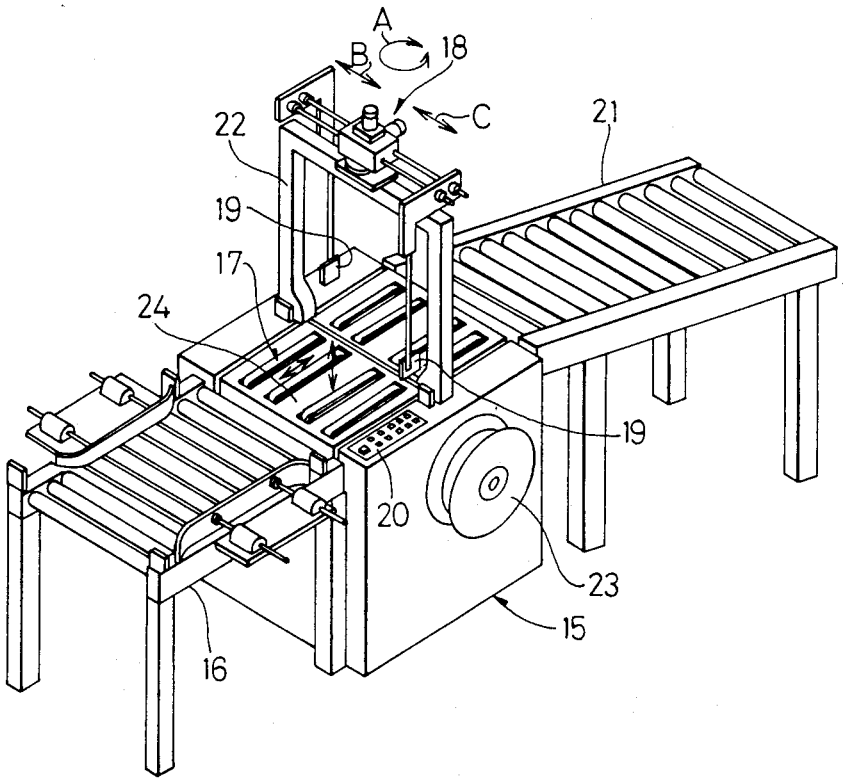
FIG. 1 is a perspective view of an automatic packing machine according to the invention.
Figure 2:
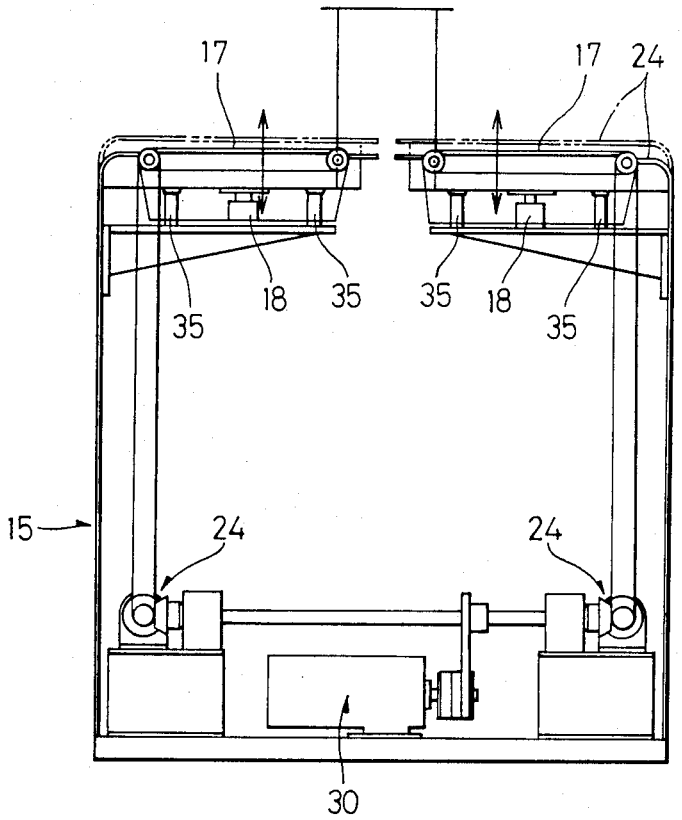
FIG. 2 is a vertically sectioned side elevational view of the main body of the packing machine.
Figure 3:
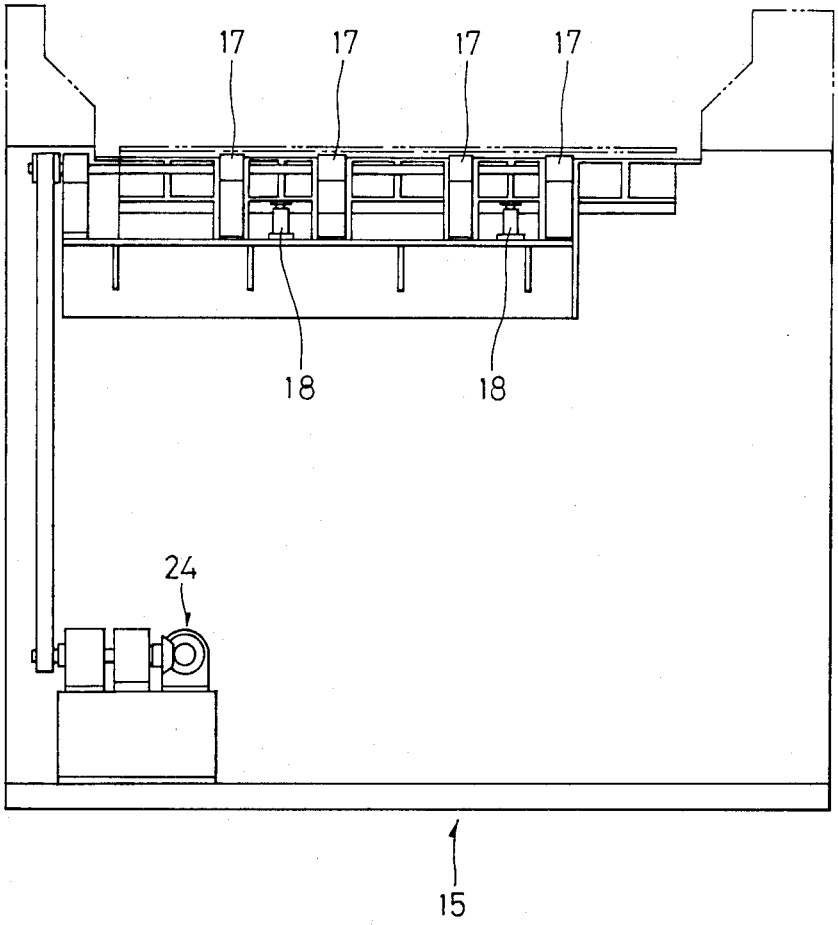
FIG. 3 is a vertically sectioned front elevational view of the packing machine.
Figure 5:
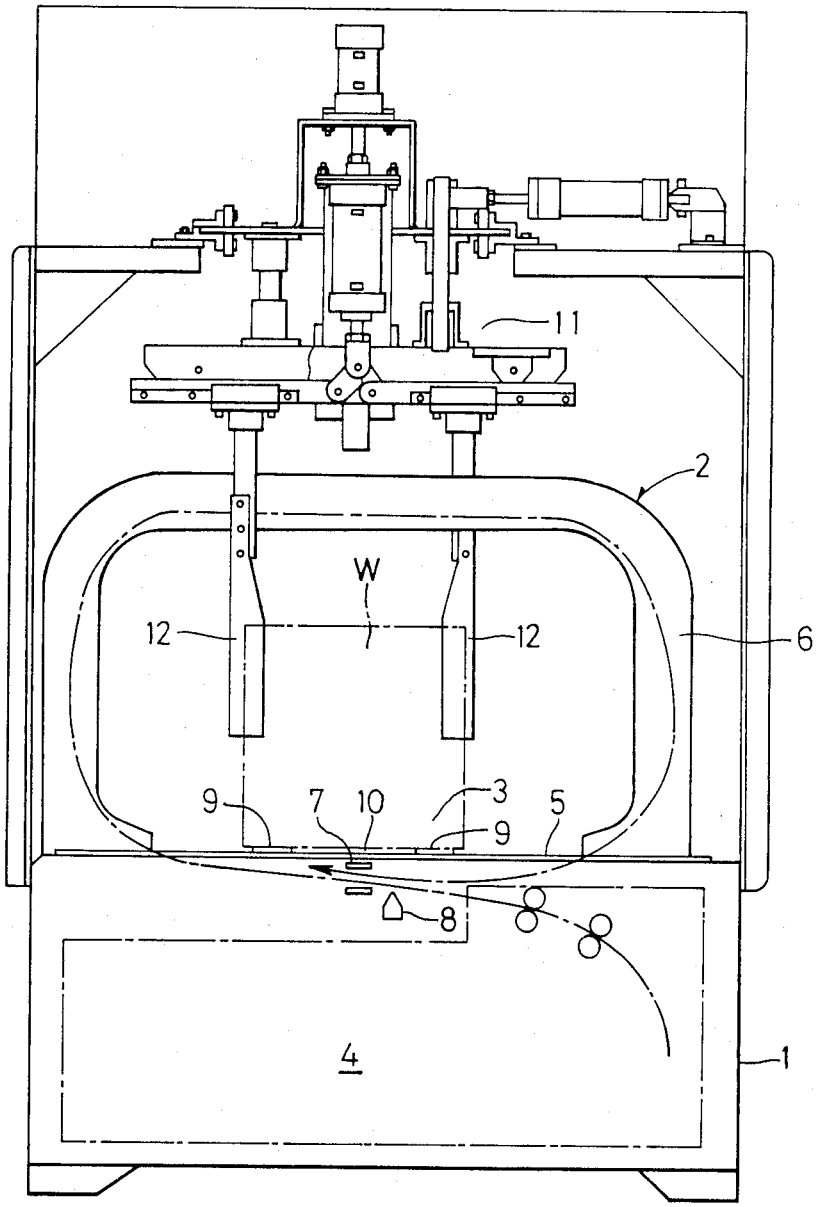
Fig. 5 PRIOR ART
FIG. 5 is a front elevational view of a conventional automatic packing macchine.
Figure 6:
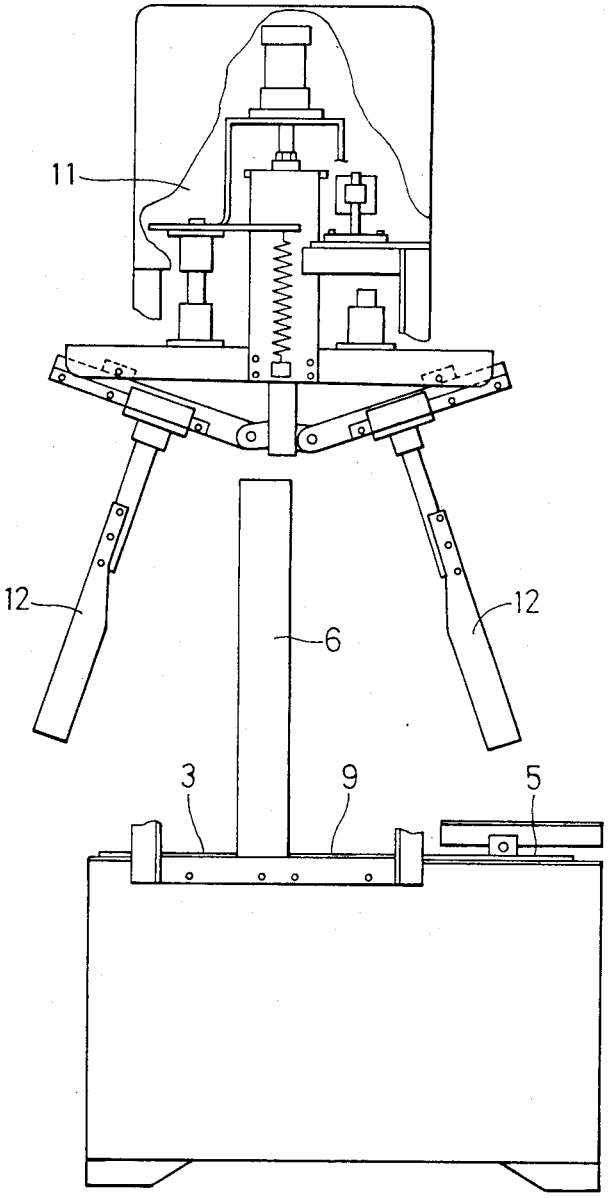
Fig. 6 PRIOR ART
FIG. 6 is a side elevational view of the conventional automatic packing machine.

Now in reference to FIGS. 1 through 3, an automatic packing machine 15 has a table 24 and a plurality of belt conveyers 17 which are located on a level slightly higher than the level of the table 24 to transport a package to be banded transversely of the table 24. The packing machine further has an upright arch 22 fixedly mounted adjacent the table 24 which is so structured as to be vertically moved between the initial position as shown in FIG. 1 in which the belt conveyers 17 may transport the package transversely of the table 24 and a position in which the table 24 is located at a level higher than the level of the conveyers 17. A reel 23 is rotatably mounted on a side of the machine 15 so as to have a band (not shown) wound therearound. The band is to be extended all through the hollow arch 22 by way of the inside of the machine 15.

The arch 22 has a turner 18 mounted on the top thereof. The turner is rotatable in one direction, for example, in the clockwise direction as shown with an arrow mark A. The turner 18 has a pair of arms 19 movable along the top of the arch 22 as shown by arrow marks B and C, one is on one side of the arch 22 and the other is on the opposite side thereof and operatively connected thereto as shown and extended down toward the table 24, so that the arms 19 may be turned and laterally moved with respect to a transporting path defined by the table 24 and the belt conveyers 17 in accordance with the operations of the turner 18.

The packing machine 15 has a control panel 20 provided thereon. The control panel 20 has a plurlaity of switch keys to be selectively depressed to automatically operate the packing machine 15 such that a package 40 in reference to FIGS. 4-A through 4-E may be banded with a single banding mode as shown in FIG. 4-A, a double parallel banding mode as shown in FIG. 4-B, a cross banding mode as shown in FIG. 4-C, a crossed single and double parallel banding mode as shown in FIG. 4-D or a crossed double parallel banding mode as shown in FIG. 4-E by means of the band 50 wound around the reel 23 in dependence upon the size and shape of the package 40.

The packing machine 15 is provided on one side thereof with a package transporting table 16 having a centering device mounted thereon for transporting the package 40 to be banded to the table 24 of the machine 15 and is further provided on the opposite side thereof another transporting table 21 of free rollers for transporting the banded package 40 away from the table 24.

As particularly shown in FIG. 2, the machine 15 has a drive motor 30 provided therein for driving the belt conveyers 17 through a transmission device including gears 26 so as to transport the package on a horizontal plane. Further the machine 15 has a plurality of linear motors 28 provided below the belt conveyers 17. The linear motors 28 are energized to vertically move the table 24 by way of vertical straight guides 35 between the lower position as shown with a solid line and the upper position as shown with a broken line. The drive motor 30 is switched over by a clutch (not shown) to drive the band 50 to be wound around the reel 23. The linear motors 28 may be replaced by so many air cylinders or by so many electric motors having cams provided in association for rotation therewith. Further the vertical straight guides 35 may be replaced by so many links.

Operation of the automatic packing machine is as follows: First of all, the switch keys of the control panel 20 are selectively depressed to determine one of the package banding modes as shown in FIGS. 4-A through 4-E in dependence upon the size and shape of the package to be banded. The package 40 is transported by the transporting table 16 having the centering device to the entrance of the table 24 of the machine 15. In case package 40 is to be banded with the single banding mode as shown in FIG. 4-A or a double parallel banding mode as shown in FIG. 4-B, the belt conveyers 17 are driven by the drive motor 30 and by way of gears 26 to transport the package 40 to a predetermined place of the table 24 with respect to the arch 22. Then the belt 50 is driven and wound around the package 40 in one direction to finish banding with the single banding mode as shown in FIG. 4-A.

In case the package is to be banded with the double parallel banding mode as shown in FIG. 4-B, a first band is wound around the package 40 in one direction, and then the belt conveyers 17 are driven to transport the package 40 in the front or rearward direction with respect to the arch 22 and a second band is wound around the package 40 in the same direction in parallel with the first band with a predetermined space provided therebetween. In these cases, the turner 18 is not used.

In case the package is to be banded with the crossed single and double parallel banding mode as shown in FIG. 4-D, the double parallel banding is performed in the manner as mentioned, and then the turner 18 is operated to move the pair of arms to hold the package 40 at the opposite sides thereof, and then the linear motors 28 are energized to move up the table 24 along the vertical straight guides 35 until the latter comes to a level slightly higher than the level of the belt conveyers 17, and then the turner 18 is operated to turn the package 40 by 90° to orientate the same to a predetermined direction, and then the table 24 is returned to the initial lower position, and then the drive motor 30 is switched over by a clutch (not shown) to drive the band 50 to wind the same around the package 40 in the direction across the preceded double parallel bands. Thus the banding operation is finished. Subsequently the belt conveyers 17 are driven to transport the banded package 40 to the transporting table 21 of free rollers for transporting the package away from the table 24. In this way, the next new package is banded with a desired banding mode.

The packing machine is automatically operated under a control of a control system including a memory storing the data of the sizes and shapes of the packages 40 to be banded and the data for determining the moving amounts and directions of the belt conveyers 17, the lateral moving amounts of the holding arms 19 and the turning amount of the turner 18 which are provided in combination with the sizes and shapes of the packages to be recovered by a selective operation of the switch keys of the control panel 20. It is however noted that the size of the package to be banded is limited in view of the machine 15 required to turn the package under the upright arch 22 of a predetermined dimensions.

It is needless to say that the present invention may be applied to a packing machine of a free roller type in contrast to the belt conveyers 17.

Thus according to the invention, it is apparent that the package to be banded may be smoothly turned on the horizontal surface of the table, and therefore the banding operation is performed with a high efficiency.

Further since the package is not moved up by the holding arms, the arms will have no additional load which may otherwise be applied thereto and the package will not be injured or damaged by the holding arms. Further since the packing machine may be structured as a module-type, the invention may be applied to an automatic packing machine of multi-functions as well as to a simple automatic packing machine. In addition the machine of the invention may be compact and the maintenance is very easy.

What is claimed is:

1. In an automatic packing machine for banding a corrugated cardboard box and including an upright arch fixedly mounted thereon, a table mounted below the arch, a turner rotably mounted relative to the arch, a pair of holding arms operatively connected to the turner and extending downward from the turner toward the table for operatively holding and turning a box located on the table to be banded with a band in a predetermined banding mode, the arch being so structured as to guide a band from a band supply to a position around the box to be banded, and a plurality of belt conveyers each having an upper conveying run located above the table for transporting the box in a step-wise fashion through the arch, the improvement comprising: said table being vertically shiftable and including a substantially smooth and planar upper box supporting surface having a plurality of openings for accommodating said belt conveyers, means for vertically shifting said table between an initial retracted position in which said upper surface is located below the upper run of said belt conveyers and an extended position in which said upper surface is located above the upper run of said belt conveyers and for maintaining said planar upper surface substantially horizontal during shifting, whereby said upper surface of said shiftable table lifts the box from said belt conveyers prior to rotation of said box by said holding arms so that said holding arms can smoothly rotate said box on said planar box supporting surface of said table.

2. The automatic packing machine of claim 1, wherein said turner is mounted on said arch.

3. The automatic packing machine of claim 1, wherein said turner is mounted on said arch for rotation within a single, fixed horizontal plane parallel to a plane defined by the upper runs of said belt conveyers.

* * * * *